US005500333A

United States Patent [19]

Eikenberry et al.

[11] Patent Number: 5,500,333

[45] Date of Patent: Mar. 19, 1996

[54] CLASS OF COMPOUNDS WHICH INCREASES AND STABILIZES PHOTOGRAPHIC SPEED

[75] Inventors: Jon N. Eikenberry; Roger Lok; Chung-Yuan Chen, all of Rochester, N.Y.

[73] Assignee: Eastman Kodak Company, Rochester, N.Y.

[21] Appl. No.: 169,478

[22] Filed: Dec. 16, 1993

[51] Int. Cl.[6] ..... G03C 1/09; G03C 1/10

[52] U.S. Cl. ..... 430/567; 430/600; 430/603; 430/605

[58] Field of Search ..... 430/567, 600, 430/603, 605

[56] References Cited

U.S. PATENT DOCUMENTS

| | | | |
|---|---|---|---|
| 3,971,664 | 7/1976 | Nakazawa et al. | 430/578 |
| 4,021,251 | 5/1977 | Sato et al. | 430/592 |
| 4,097,284 | 6/1978 | Tani | 430/576 |
| 4,378,426 | 3/1983 | Lok et al. | 430/505 |
| 4,434,226 | 2/1984 | Wilgus et al. | 430/567 |
| 4,451,557 | 5/1984 | Lok et al. | 430/505 |
| 4,594,317 | 6/1986 | Sasaki et al. | 430/567 |
| 4,609,621 | 9/1986 | Sugimoto et al. | 430/567 |
| 4,678,741 | 7/1987 | Yamada et al. | 430/567 |
| 4,780,399 | 10/1989 | Urata | 430/567 |
| 4,906,557 | 3/1990 | Becker et al. | 430/567 |
| 4,916,053 | 4/1990 | Ohshima et al. | 430/567 |
| 5,250,403 | 10/1993 | Antoniades et al. | 430/567 |

FOREIGN PATENT DOCUMENTS

| | | |
|---|---|---|
| 58-107533 | 6/1983 | Japan . |
| WO92/12462 | 7/1992 | WIPO . |

*Primary Examiner*—Janet C. Baxter
*Attorney, Agent, or Firm*—Paul A. Leipold

[57] ABSTRACT

The invention is generally accomplished by providing a method of finishing an emulsion comprising providing silver halide grains, adding to said emulsion in an amount between about 0.005 mmol/per mole of silver and 0.10 mmol/per mole of silver of the compound

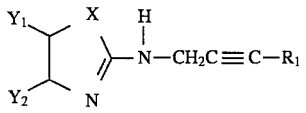

X=O, S, Se;

$R_1$=alkyl or substituted alkyl or aryl or substituted aryl;

$Y_1$ and $Y_2$ individually represent hydrogen, alkyl groups or an aromatic nucleus or together represent the atoms necessary to complete a cyclic structure containing carbon, oxygen, selenium, or nitrogen atoms necessary to complete a fused aromatic nucleus or an alicyclic structure. The invention also provides a photographic element comprising the silver halide emulsion. In a preferred embodiment, the $R_1$ substituent is methyl or phenyl.

20 Claims, No Drawings

CLASS OF COMPOUNDS WHICH INCREASES AND STABILIZES PHOTOGRAPHIC SPEED

FIELD OF THE INVENTION

This invention relates to novel compounds capable of increasing photographic speed and reducing latent image fading when incorporated in photographic silver halide emulsions, to the photographic emulsions in which they are incorporated, and to photographic elements containing the emulsions.

BACKGROUND OF THE INVENTION

A visible image is formed in silver halide photographic materials by exposure of the material to actinic radiation to form a record of the exposure which is invisible to the unaided eye, followed by processing of the material to yield a visible image.

The invisible record of exposure is referred to as a latent image. It is generally agreed that the latent image comprises minute specks of metallic silver formed in or on individual silver halide grains by interaction between silver ions and photoelectrons generated by absorption of actinic radiation by the silver halide grains.

Processing of most common silver halide photographic materials includes a development step in which the material is contacted with an aqueous alkaline solution of a developing agent. The developing agent is a reducing agent which will selectively reduce to metallic silver those silver halide grains containing a latent image.

It is known that the latent image is not permanent and that, with the passage of time, silver halide grains which would be developable immediately after exposure become nondevelopable. This phenomenon is termed latent image fading and manifests itself as a loss in image density in the developed image and a consequent loss in speed in the silver halide photographic material.

If silver halide materials were developed immediately following imagewise exposure, latent image fading would not be a problem. However, with many silver halide materials, delays between exposure and processing frequently occur. For example, with amateur film materials in which multiple images are formed on a single roll of film, there is often a delay of months between the time the first image is exposed and the time the exposed roll of film is sent for processing. With such materials latent image fading can present a significant problem, and compounds are added to photographic materials to prevent or reduce it. These compounds are referred to as latent image stabilizing compounds or latent image stabilizers, and the prevention or reduction of latent image fading is referred to as latent image stabilization.

Among latent image stabilizers known in the art are N-2-propenylbenzothiazolium and naphthothiazotium salts described in Arai et al U.S. Pat. No. 3,954,478. N-2-propenyl substituent containing acyclic compounds useful as latent image stabilizers are disclosed in Herz U.S. Ser. No. 236,360 filed Feb. 20, 1981, SILVER HALIDE EMULSIONS CONTAINING LATENT IMAGE STABILIZING COMPOUNDS, now U.S. Pat. No. 4,374,196. Latent image stabilizers containing a 2-propynylthio substituent are disclosed by von Konig et al U.S. Pat. No. 3,910,791.

U.S. Pat. No. 4,451,557—Lok et al and U.S. Pat. No. 4,378,426—Lok et al disclose photographic silver halide emulsions that have been treated to increase speed and reduce latent image fading. These patents disclose a large group of aminobenzoxazoles that have been found to reduce image fading with some speed increase.

PROBLEM TO BE SOLVED BY THE INVENTION

While the above materials provide a decrease in fading and sometimes a speed increase, there remains a need for a compound that will provide an emulsion with greater consistent speed increase, while also preventing latent image fading. Further, it is desirable that compounds be found that avoid speed gains after latent image storage as seen in U.S. Pat. No. 4,451,557.

SUMMARY OF THE INVENTION

An object of the invention is to overcome disadvantages of prior materials.

A further object is to provide emulsions having improved latent image keeping and increased speed.

A further object is to provide emulsions that have stable speed during aging.

These and other objects of the invention are generally accomplished by providing a method of finishing an emulsion comprising providing silver halide grains, adding to said emulsion in an amount between about 0.005 mmol/per mole of silver and 0.10 mmol/per mole of silver of the compound

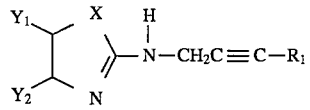

X=O, S, Se;

$R_1$=alkyl or substituted alkyl or aryl or substituted aryl;

$Y_1$ and $Y_2$ individually represent hydrogen, alkyl groups or an aromatic nucleus or together represent the atoms necessary to complete a cyclic structure containing carbon, oxygen, selenium, or nitrogen atoms necessary to complete a fused aromatic nucleus or an alicyclic structure. The invention also provides a photographic element comprising the silver halide emulsion. In a preferred embodiment, the $R_1$ substituent is methyl or phenyl.

ADVANTAGEOUS EFFECT OF THE INVENTION

The invention has numerous advantages in emulsion sensitization. The invention allows a stable speed to be maintained for the emulsion with improved latent image keeping. Further, the material of the invention allows an increase in speed when the invention material is added to the emulsion. The speed increase remains stable through aging. Further, the invention allows the increase in speed and improvement in latent image keeping with only a small amount of the substituent utilized in the emulsion. Prior materials require a greater amount of the constituent, thereby increasing cost and product bulk. These and other advantages will be apparent from the description below.

DETAILED DESCRIPTION OF THE INVENTION

The ability of compounds having structures represented by I and II to produce increases in photographic speed and latent image stabilization has been described in previous patents (U.S. Pat. Nos. 4,378,426 and 4,451,557). In this invention it has been discovered that a subclass of these structures (namely II where $R^1$=alkyl or aryl) can give very large speed gains and exceptional latent image stability when added during the chemical sensitization of photographic emulsions.

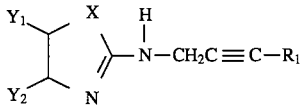

I—$R_1$=H

II—$R_1$=alkyl or aryl

X=O, S, Se;

$R_1$=alkyl or substituted alkyl or aryl or substituted aryl;

$Y_1$ and $Y_2$ individually represent hydrogen, alkyl groups or an aromatic nucleus or together represent the atoms necessary to complete a cyclic structure containing carbon, oxygen, selenium, or nitrogen atoms necessary to complete a fused aromatic nucleus or an alicyclic structure.

In a preferred form of the invention, an alkynylamino substituent is attached to a benzoxazole, benzothiazole, benzoselenazole, or heterocyclic nucleus. In one specific preferred form, the compounds II of the present invention and companion non-invention compounds I can be represented by the following formula:

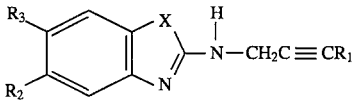

wherein

I—$R_1$=H

Ia—$R_1$=H, $R_2$=H, X=O

Ib—$R_1$=H, $R_2$= Me, X=O

Ic—$R_1$=H, $R_2$=H, X=S

II—$R_1$=alkyl or aryl

IIa—$R_1$=Me, $R_2$=H, X=O $R_3$=H

IIb—$R_1$=Me, $R_2$=Me, X=O $R_3$=H

IIc—$R_1$=Me, $R_2$=H, X=S $R_3$=H

IId—$R_1$=Ph, $R_2$=H, X=O $R_3$=H

Other preferred II structures have $R_1$ as ethyl, propyl, p-methoxyphenyl, p-tolyl, or p-chlorophenyl with $R_2$ or $R_3$ as halogen, methoxy, alkyl, or aryl.

Whereas previous work employing compounds with structure similar to I and II described speed gains of about 40% using 0.10 mmole/silver mole when added after sensitization and prior to forming the layer containing the emulsion (U.S. Pat. No. 4,451,557), we obtain speed gains which can range from 66% (Example 1 in Table 1) to over 250% (Example 19 in Table 4) depending on the emulsion and senstitzing dye utilized by adding 0.02–0.03 mmole/silver mole of II during the sensitization step.

Furthermore, we have made the unexpected observation that only those compounds described by structure II where $R_1$ is an alkyl, aryl or similar group are effective (IIa, IIb, IIc, IId) whereas compounds in which $R_1$ is a hydrogen (Ia, Ib, Ic) are ineffective and cause large increases in photographic fog. Previous work made no such selection of the invention compounds.

The compound II of the present invention typically contains an $R_1$ that is an alkyl or aryl. It is found to be preferred that the $R_1$ be either a methyl or a phenyl ring for the best increase in speed and latent image keeping.

The compounds of the invention are added to the silver halide emulsion at a point subsequent to precipitation and prior to the heat treatment of the chemical sensitization process. They may be added prior to or subsequent to the addition of the chemical and/or spectral sensitizing materials. Any of the conventional chemical sensitizers such as gold and sulfur compounds may be utilized. Further, any spectral sensitizers such as the various dyes provide increased spectral sensitivity range to the silver halide grains.

The invention material and process for applying it to silver halide grains may be utilized with any silver halide grain. Typical of such grains are silver bromide, silver iodide, silver bromoiodide, and various crystal structures as tabular, cubic, and octahedral. The process and material of the invention find the preferred use in small tabular grains of between about 0.4 and 8 microns diameter and of a silver bromoiodide composition.

The invention may be utilized with any silver halide photographic element. Typical of such materials are x-ray films, color photographic paper, black-and-white photographic paper, and reversal films. It finds preferred use in color negative film where the increase in speed with latent image keeping properties are especially important. The amount of invention compound utilized in treating the silver halide grains may be any amount that provides a desired improvement in latent image keeping speed. A preferred range has been found to be between about 0.002 mmole per mole of silver and about 0.2 mmole per mole of silver added prior to heating of the emulsion during sensitization. The method and emulsion of the invention find the most preferred amount of the compound to be in a range of between about 0.005 mmole and about 0.1 mmole per mole of silver for best increase in speed and stability on storage.

The preferred tabular grains for utilization in the invention have an aspect ratio of greater than 8 to 1. The preferred grains have a thickness of less than 0.1 micron and preferably between about 0.03 and about 0.08 microns in thickness. The preferred grains also have a diameter of between about 0.2 and about 10 microns with a most preferred diameter of between about 0.4 and about 5 microns.

Diameter measurements described herein refer to median values for the equivalent circular diameter, i.e., the diameter of a circle having an area equal to the projected area of the grain. Diameter measurements were done using standard sedimentation techniques in a disc centrifuge. Thickness measurements were done according to the method described in U.S. Pat. No. 5,250,403.

The photographic elements formed by the invention may utilize conventional peptizing materials and be formed on conventional base materials such as polyester and paper. Further, other various conventional plasticizers, antifoggants, brighteners, bacterialcides, hardeners and coating aids may be utilized. Such conventional materials are found in *Research Disclosure,* Item 308119 of December, 1989.

A preferred color photographic element according to this invention comprises a support bearing at least one blue-sensitive silver halide emulsion layer having associated therewith a yellow dye-forming coupler, at least one green-sensitive silver halide emulsion layer having associated therewith a magenta dye-forming coupler and at least one red-sensitive silver halide emulsion layer having associated therewith a cyan dye-forming coupler, at least one of the silver halide emulsions layers containing a latent image stabilizing compound of this invention. In accordance with a particularly preferred aspect of the present invention, the invention compound is contained in a yellow dye-forming blue-sensitive silver emulsion.

The elements of the present invention can contain additional layers conventional in photographic elements, such as overcoat layers, spacer layers, filter layers, antihalation layers, scavenger layers, and the like. The support can be any suitable support used with photographic elements. Typical supports include polymeric films, paper (including polymer-coated paper), glass, and the like. Details regarding supports and other layers of the photographic elements suitable for this invention are contained in *Research Disclosure,* December 1978, Item 17643.

The following examples illustrate the practice of this invention. They are not intended to be exhaustive of all possible variations of the invention. Parts and percentages are by weight unless otherwise indicated.

Example Ia

Compound Ia is identical to Compound A in U.S. Pat. No. 4,451,557 herein incorporated by reference and was prepared according to the procedure described in that patent.

Example Ib

Compound Ib was prepared in the same manner as Ia except 5-methyl-2-chlorobenzoxazole was substitued for 2-chlorobenzoxazole in the synthetic procedure.

Example Ic

Compound Ic is identical to Compound B in U.S. Pat. No. 4,378,426 herein incorporated by reference and was prepared according to the procedure described in that patent.

Example IIa

Compound IIa is identical to Compound J in U.S. Pat. No. 4,451,557 herein incorporated by reference and was prepared according to the procedure described in that patent.

Example IIb

Compound IIb was prepared according to the following procedure:

To 30 mmoles of 5-methyl-2-chlorobenzoxazole (made from the corresponding 2-thione and $PCl_5/POCl_3$) in 100 ml of acetonitrile was added an equivalent of 2-butynylammonium p-toluenesulfonate and two equivalents of triethylamine in 50 ml of acetonitrile. The solution was refluxed for 3.5 hours. The crude product was chromatographed to give the crystalline desired product, mp 126–128 C. The product gave the correct spectral (NMR, IR and FDMS) and microanalytical results.

Example IIc

Compound IIc was prepared according to the following procedure:

2-Chlorobenzothiazole (20 mmole) was dissolved in 50 ml of acetonitrile. To the solution was added an equivalent of 2-butynylammonium p-toluenesulfonate and two equivalents of triethylamine. The mixture was refluxed for 72 hours and the crude product was chromatographed to give the crystalline, desired product, mp 125°–126° C. The product gave the correct spectral (NMR, IR and FDMS) and microanalytical results.

Example IId

Compound IId was prepared according to the following procedure:

To 7.4 mmoles of 3-phenyl-2-propynylamine hydrochloride in 50 ml of actonitrile was added in a dropwise fashion 8.1 mmoles of 2-chlorobenzoxazole and 15 mmoles of trietylamine in 20 ml of acetonitrile. The clear solution was refluxed for 4 hours. The solvent was then removed and the residue recrystallized in diethyl ether/ligroin to give the crystalline, desired product, mp 137°–138° C. The product gave the correct spectral (NMR, IR and FDMS) and microanalytical results.

Comparative Example Control A

This is a control coating. No speed additive is present. A simple single layer was coated on a pad of gelatin with a gelatin overcoat to protect the coating from abrasion. The active layer contained an image forming coupler and an image modifying coupler both producing a yellow dye together with an emulsion which had been chemically and spectrally sensitized. A fog suppressant such as 4-hydroxy-6-methyl-1,3,3a,7-tetraazaindene (TAI) or 4-hydroxy-5-bromo-6-methyl-1,3,3a,7-tetraazaindene (Br-TAI) was found to be very useful for controlling the fog and pressure sensitivity of the coated emulsions. The structure was as follows:

Layer 3—Overcoat
2.15 g/m$^2$ gelatin

Layer 2—Yellow Dye Forming Layer
2.15 g/m$^2$ gelatin+1.37 g/m$^2$ imaging coupler, C-1, +0.032 g/m$^2$ image modifying coupler, C-3, +0.54 g/m$^2$ AgBrI emulsion treated with a yellow sensitizing dye and chemically sensitized with sulfur and gold+0.008 g/m$^2$ of a fog suppressant.

Layer 1—Gelatin Pad
4.89 g/m$^2$ gelatin

Film Support—Cellulose Acetate

Imaging Couplers

C-1

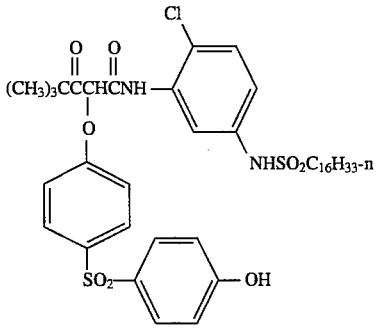

C-2

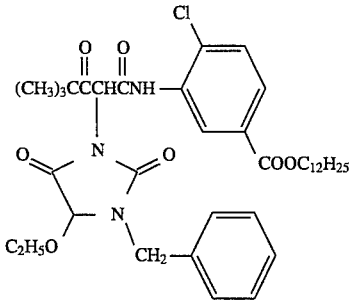

-continued

Image Modifying Couplers

C-3

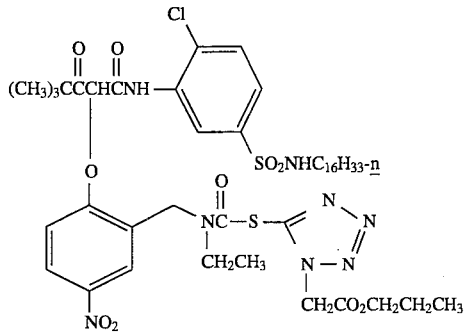

C-4

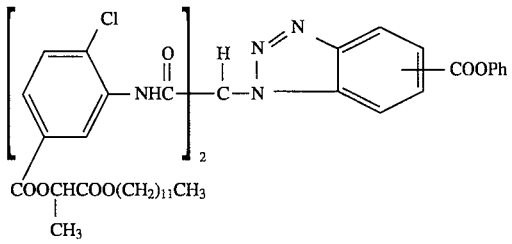

Yellow Sensitizing Dyes

D-1

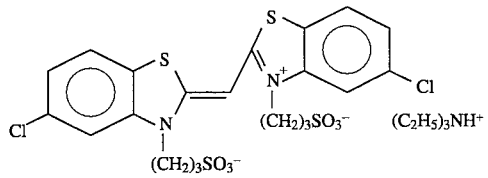

D-2

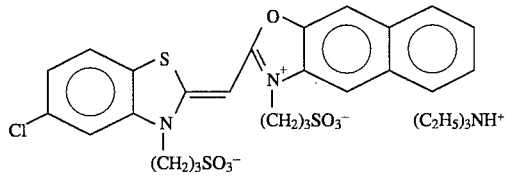

Emulsion for Comparative Example Control A

A tabular grain emulsion was prepared according to the procedure described by Antoniades et al for emulsion TE-4 in U.S. Pat. No. 5,250,403 with slight modifications. The emulsion was sensitized by treatment with sodium thiocyanate and the yellow sensitizing dye, D-1, followed by sulfur sensitization with 1,3 -dicarboxymethyl-1,3-dimethyl-2-thiourea (DCT) as described by Burgmaier in U.S. Pat. No. 4,810,626 and gold sensitization with aurous bis(1,4,5-trimethyl-1,2,4 -triazolium-3-thiolate (AuTT) as described by Deaton in U.S. Pat. No. 5,049,485. The emulsion consisted of silver bromoiodide grains containing 3% iodide with the dimensions of 1.44 μm equivalent circular diameter and 0,050 μn thickness.

The specific procedure for sensitization was as follows:

The emulsion was treated with 200 mg/mole silver of sodium thiocyanate for 20 min at 40° C. Sensitizing dye, D-1, was then added at 2.4 mmole/mole silver followed by the speed additive if used. DCT at 16 mg/silver mole was added followed immediately by 12 mg/mole silver of AuTT and 37 mg/mole silver of finish modifier, 3-(methylsulfonylcarbamoylethyl)-benzothiazolium tetrafluoroborate, which is an antifoggant requiring a ring opening mechanism in order to activate its acidic sulfur atom. The mixture was then heated to 55° C. and held for 15 min before being cooled back to 40° C.

Table 1 contains the exposing, processing and sensitometric results for this series.

EXAMPLE 1

Example 1 is identical to Control A except that 0.03 mmole/mole silver of Compound IIa was added during the sensitization process.

EXAMPLE 2

Example 2 is identical to Control A except that 0.03 mmole/mole silver of Compound IIb was added during the sensitization process.

EXAMPLE 3

Example 3 is identical to Control A except that 0.03 mmole/mole silver of Compound IIc was added during the sensitization process.

EXAMPLE 4

Example 4 is identical to Control A except that 0.03 mmole/mole silver of Compound Ia was added to the emulsion and the melt was heated at 65° C for 15 min. prior to chemical sensitization to solubilize IId.

EXAMPLE 5

Example 5 is identical to Control A except that 0.03 mmole/mole silver of Compound Ib was added during the sensitization process.

EXAMPLE 6

Example 6 is identical to Control A except that 0.03 mmole/mole silver of Compound Ic was added during the sensitization process.

Comparative Example Control B

Control B is identical to Control A except that the size of the emulsion is 1.85 μm×0.065 μm and 1.18 g/m$^2$ imaging coupler C-2 and 0.032 g/m$^2$ image modifying coupler C-4 were utitlized. The finishing conditions were the same as in Control A except reagent concentrations were adjusted to compensate for differences in the surface area of the two emulsions. No speed additive is present.

EXAMPLE 7

Example 7 is identical to Control B except that 0.20 mmole/mole silver of Compound IIa was added after the sensitization process at the time of coating as a melt addendum.

EXAMPLE 8

Example 8 is identical to Control B except that 0.02 mmole/mole silver of Compound IIa was added during the sensitization process.

Comparative Example Control C

Control C is identical to Control A except that the size of the emulsion is 1.18 μm×0.053 μm and 1.18 g/m$^2$ imaging coupler C-2 and 0.032 g/m$^2$ image modifying coupler C-4 were utitlized. The finishing conditions were the same as in Control A except reagent concentrations were adjusted to compensate for differences in the surface area of the two emulsions. No speed additive is present.

EXAMPLE 9

Example 9 is identical to Control C except that 0.10 mmole/mole silver of Compound IIa was added after the sensitization process and at the time of coating as a melt addendum.

EXAMPLE 10

Example 10 is identical to Control C except that 0.02 mmole/mole silver of Compound IIa was added during the sensitization.

Comparative Example Control D

Control D is identical to Control A except that the size of the emulsion is 1.04×0.046 μm. The finishing conditions were the same as in Control A except reagent concentrations were adjusted to compensate for differences in the surface area of the two emulsions. No speed additive is present.

EXAMPLE 11

Example 11 is identical to Control D except that 0.03 mmole/mole silver Compound IIa is added during the sensitization.

Comparative Example Control E

Control E is identical to Control A except that the size of the emulsion is 3.02×0.057 μm. The finishing conditions were the same as in Control A except reagent concentrations were adjusted to compensate for differences in the surface area of the two emulsions. No speed additive is present.

EXAMPLE 12

Example 12 is identical to Control E except that 0.02 mmole/mole silver Compound IIa is added during the sensitization.

EXAMPLE 13

Example 13 is identical to Control E except that 0.03 mmole/mole silver of Compound IId was added during the sensitization process.

Comparative Example Control F

Control F is identical to Control A except that the size of the emulsion is 4.98×0.066 μm. The finishing conditions were the same as in Control A except reagent concentrations were adjusted to compensate for differences in the surface area of the two emulsions. No speed additive is present.

EXAMPLE 14

Example 14 is identical to Control F except that 0.02 mmole/mole silver Compound IIa is added during the sensitization.

Comparative Example Control G

Control G is identical to Control A except the emulsion belongs to the class described as run/dump and was prepared according to the procedure described by Wightman and Johnson in U.S. Pat. No. 5,061,616. For the first 70% of the make, iodide is added uniformly at the rate of 1.5% of the total silver halide. At 70% of the make, silver iodide is dumped into the making kettle in the amount of 5% of the total silver halide present. An outer shell of silver bromide was then applied to complete the make. The emulsion size is 1.03×0.09 μm. The sensitizing conditions were the same as in Control A except reagent concentrations were adjusted to compensate for differences in the surface area of the two emulsions. No speed additive is present.

EXAMPLE 15

Example 15 is identical to Control G except that 0.02 mmole/mole silver Compound IIa is added during the sensitization.

Comparative Example Control H

Control H is identical to Control A except that the emulsion consists of cubic grains containing silver combined with 97% bromide and 3% iodide and with an edge length of 0.54 μm. The finishing conditions were the same as in Control A except reagent concentrations were adjusted to compensate for differences in the surface area of the two emulsions. No speed additive is present.

EXAMPLE 16

Example 16 is identical to Control H except that 0.02 mmole/mole silver Compound IIa is added during the sensitization.

Comparative Example Control I

Control I is identical to Control A except that the emulsion consists of octahedral grains containing silver combined with 95% bromide and 5% iodide and with an ECD of 0.37 μm. These grains contain banded iodide and were prepared according to U.S. application Ser. No. 759,325, Photographic Silver Bromoiodide Emulsions, Elements and Processes, Chang et al., filed Sep. 13, 1991. No speed additive is present.

EXAMPLE 17

Example 17 is identical to Control I except that 0.02 mmole/mole silver Compound IIa is added during the sensitization.

Comparative Example Control K

Control K is identical to Control E except that the emulsion was chemically sensitized without dye. No speed additive is present.

EXAMPLE 18

Example 18 is identical to Control K except that 0.03 mmole/mole silver Compound IIa is added during the sensitization.

Comparative Example Control L

Control L is identical to Control K except that the emulsion was spectrally sensitized with dye D-1. No speed additive is present.

EXAMPLE 19

Example 19 is identical to Control L except that 0.03 mmole/mole silver Compound IIa is added during the sensitization.

Comparative Example Control M

Control M is identical to Control K except that the emulsion was spectrally sensitized with dye D-2. No speed additive is present.

EXAMPLE 20

Example 20 is identical to Control M except that 0.02 mmole/mole silver Compound IIa is added during the sensitization.

TABLE 1

Effect of Compounds Represented by I and II on Photographic Performance when Added in the Sensitization Step

| Coating | Additive | Amount mmol/mole Ag | Fresh Fog | Relative Speed |
|---|---|---|---|---|
| Control A | None | — | .07 | 100 |
| Example 1 | IIa | 0.03 | .10 | 166 |
| Example 2 | IIb | 0.03 | .11 | 178 |
| Example 3 | IIc | 0.03 | .08 | 132 |
| Example 4 | Ia | 0.03 | .61 | 158 |
| Example 5 | Ib | 0.03 | .55 | 174 |
| Example 6 | Ic | 0.03 | .20 | 170 |

Exposure at 1/50s, 5500° C. with Wratten 2B filter. Processing in standard C41 color process for 3.25 min. (See British Journal of Photography, Vol. 36, #6, pp. 196–198 (1988)). Relative speed is measured at 0.15 above Dmin.

Large gains in photographic speed were observed when IIa was added either as a melt addendum or when it was added during the sensitization procedure. However, when IIa was added in the sensitization step, ⅕th to 1/10th of the amount was needed to obtain fresh speed gains that exceeded those obtained when the same compound was added after the sensitization as a melt addendum (Table 2). Furthermore, IIa added in the sensitization appears to be effective at preventing photographic speed changes either after the coated film is incubated, exposed and processed (Raw Stock Keeping, RSK) or after it is exposed, incubated and then processed (Latent Image Keeping, LIK).

As can be seen in Table 2, the addenda IIa not only greatly increases the fresh speed, but also stabilizes the speed to incubation. The controls in Table 2 both show large gains in RSK speed and large losses in LIK speed that are greatly attenuated by the addition of IIa.

TABLE 2

Effect of II on Photographic Speed Observed Fresh and after Latent Image Keeping

| Coating | Additive | Point of Addition | Amount mmol/mole Ag | Fresh Fog | Relative Speed Fresh | RSK | LIK |
|---|---|---|---|---|---|---|---|
| Control B | None | — | — | .07 | 100 | 145 | 79 |
| Example 7 | IIa | melt | .200 | .10 | 186 | 182 | 166 |
| Example 8 | IIa | sensitize | .020 | .16 | 195 | 186 | 204 |
| Control C | None | — | — | .07 | 100 | 145 | 44 |
| Example 9 | IIa | melt | .100 | .07 | 204 | 191 | 178 |
| Example 10 | IIa | sensitize | .020 | .16 | 219 | 182 | 209 |

Fresh speed is measured at 0.15 above Dmin. RSK speed is measured in the same manner as fresh speed except the coating is first held at 120° F./50% relative humidity for 1 week, exposed and then processed immediately. LIK speed is measured in the same manner as fresh speed except the coating is first exposed and then held at 120° F./50% relative humidity for 1 week before being processed.

A distinct advantage of the present invention is the very stable speed observed with latent image keeping. Whereas previous work demonstrated the reduction of latent image speed loss (U.S. Pat. Nos. 4,378,426 and 4,451,557) with emulsions that were not spectrally sensitized, when the method was applied to blue sensitized (yellow dye forming) emulsions, substantial speed increases were observed with latent image keeping. The present invention has the advantage of yielding much more stable speeds following latent image keeping (LIK).

Compounds with structure II are effective at producing speed increases and improved LIK not only with tabular grains, but with other morphologies as well. Cubic and ochtahedral grains showed marked improvement in photographic performance with the addition of IIa (Table 3).

TABLE 3

Effect of II on the Photographic Performance of Emulsions of Different Morphology

| Coating | Morphology | Grain Dimension | Additive | Amount mmole/mole Ag | Fresh Fog | Relative Speed Fresh | LIK |
|---|---|---|---|---|---|---|---|
| Control D | tabular | 1.04 × .046 | — | — | 0.06 | 100 | 49 |
| Example 11 | tabular | 1.04 × .046 | IIa | .03 | 0.06 | 214 | 186 |
| Control E | tabular | 3.02 × .057 | — | — | 0.09 | 100 | 81 |

TABLE 3-continued

Effect of II on the Photographic Performance of Emulsions of Different Morphology

| Coating | Morphology | Grain Dimension | Additive | Amount mmole/mole Ag | Fresh Fog | Relative Speed Fresh | Relative Speed LIK |
|---|---|---|---|---|---|---|---|
| Example 12 | tabular | 3.02 × .057 | IIa | .02 | 0.10 | 166 | 155 |
| Example 13 | tabular | 3.02 × .057 | IId* | .03 | 0.11 | 141 | 115 |
| Control F | tabular | 4.98 × .066 | — | — | 0.09 | 100 | 100 |
| Example 14 | tabular | 4.98 × .066 | IIa | .02 | 0.11 | 174 | 191 |
| Control G | tabular | 1.03 × .090 | — | — | 0.07 | 100 | 63 |
| Example 15 | tabular | 1.03 × .090 | IIa | .02 | 0.12 | 159 | 129 |
| Control H | cubic | 0.54 | — | — | 0.05 | 100 | 79 |
| Example 16 | cubic | 0.54 | IIa | .02 | 0.05 | 151 | 148 |
| Control I | octahedral | 0.37 | — | — | 0.07 | 100 | 83 |
| Example 17 | octahedral | 0.37 | IIa | .02 | 0.08 | 145 | 138 |

*IId was solubilized by heating with the emulsion at 65° C. for 15 min.

TABLE 4

Effect of II on Photographic Performance in the Presence and Absence of Sensitizing Dye

| Coating | Additive | Amount mmole/mole Ag | Dye | Fresh Fog | Fresh Relative Speed |
|---|---|---|---|---|---|
| Control K | — | — | None | 0.08 | 100 |
| Example 18 | IIa | 0.03 | None | 0.16 | 191 |
| Control L | — | — | 1 | 0.07 | 100 |
| Example 19 | IIa | 0.03 | 1 | 0.13 | 251 |
| Control M | — | — | 2 | 0.08 | 100 |
| Example 20 | IIa | 0.02 | 2 | 0.09 | 200 |

The invention has been described in detail with particular reference to preferred embodiments thereof, but it will be understood that variations and modifications can be effected within the spirit and scope of the invention.

We claim:

1. A method of sensitizing an emulsion comprising providing a silver bromoiodide emulsion, during sensitizing of said emulsion, adding to said emulsion dye, gold sensitizer, sulfur sensitizer, thiocyanate, and an amount between about 0.02 and 0.03 mmol/mole of silver of the compound

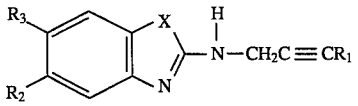

wherein $R_1$ is alkyl, hydrogen, aryl, p-methoxyphenyl, p-tolyl, or p-chlorophenyl;

X is O or S;

$R_2$ and $R_3$ are hydrogen, halogen, methoxy, alkyl, or aryl, and with the proviso that the silver halide grains of said silver bromoiodide emulsion comprise less than 0.1 microns in thickness, and then heating for chemical sensitization.

2. The method of claim 1 wherein said emulsion comprises tabular silver halide grains of an aspect ratio of greater than 8 to 1.

3. The method of claim 1 wherein the silver halide grains of said silver halide emulsion are between about 0.03 and 0.08 microns in thickness.

4. The method of claim 3 wherein the silver halide grains of said silver halide emulsion have a diameter of between about 0.2 to 10 microns.

5. The method of claim 3 wherein the silver halide grains of said silver halide emulsion have a diameter of between about 0.4 and about 5 microns.

6. The method of claim 1 wherein said compound comprises

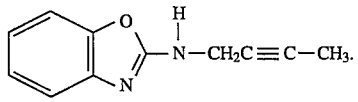

7. The method of claim 1 wherein $R_3$ is H, $R_1$ is methyl, and $R_2$ is methyl or H.

8. The method of claim 1 wherein $R_1$ is methyl, $R_2$ is H, X is O and $R_3$ is H.

9. The method of claim 1 wherein $R_1$ is methyl, ethyl, propyl, or phenyl.

10. The method of claim 1 wherein $R_3$ is H, $R_2$ is H or methyl, and $R_1$ is methyl or phenyl.

11. A photographic element comprising at least one silver bromoiodide emulsion wherein the grains of said emulsion have on their surface between about 0.02 mmol/mole of silver and about 0.03 mmol/mole of silver of the compound

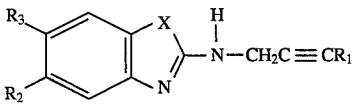

wherein $R_1$ is alkyl, hydrogen, aryl, p-methoxyphenyl, p-tolyl, or p-chlorophenyl;

X is O or S;

$R_2$ and $R_3$ are hydrogen, methyl, halogen, methoxy, alkyl, or aryl, and with the proviso that the silver halide grains of said silver bromoiodide emulsion comprise less than 0.1 microns in thickness.

12. The element of claim 11 wherein said compound comprises

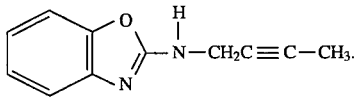

13. The element of claim 11 wherein said emulsion comprises tabular silver halide grains of an aspect ratio of greater than 8 to 1.

14. The element of claim 11 wherein said grains are between about 0.03 and 0.08 microns in thickness.

15. The element of claim 11 wherein said grains have a diameter of between about 0.2 to 10 microns.

16. The element of claim 11 wherein said grains have a diameter of between about 0.4 and about 5 microns.

17. The element of claim 11 wherein $R_3$ is H, $R_1$ is methyl, and $R_2$ is methyl or H.

18. The method of claim 11 wherein $R_1$ is methyl, $R_2$ is H, X is O and $R_3$ is H.

19. The element of claim 11 wherein $R_1$ is methyl, ethyl, propyl, or phenyl.

20. The element of claim 11 wherein $R_3$ is H, $R_2$ is H or methyl, and $R_1$ is methyl or phenyl.

* * * * *